US005971827A

United States Patent [19]

Lee et al.

[11] Patent Number: 5,971,827

[45] Date of Patent: Oct. 26, 1999

[54] NOVELTY SOAP

[76] Inventors: Allan C. K. Lee, 3196 Chamberlain Court, Mississauga, Ontario, Canada, L5N 3M2; Shu Hong Wong, 31 Cindy Nicholas Drive, Scarborough, Ontario, Canada, M1E 5C4

[21] Appl. No.: 08/916,998

[22] Filed: Aug. 20, 1997

[51] Int. Cl.[6] ..... A63H 5/00

[52] U.S. Cl. ..... 446/81; 446/175; 446/404; 510/143

[58] Field of Search ..... 446/71–73, 81, 446/175, 404, 485; 40/442, 541, 550; D28/8.1, 8.2; 510/141, 143, 144, 147

[56] References Cited

U.S. PATENT DOCUMENTS

| | | | |
|---|---|---|---|
| 1,192,803 | 7/1916 | Tucker et al. . | |
| 2,677,913 | 5/1954 | Swartz . | |
| 3,403,106 | 9/1968 | Story et al. . | |
| 3,413,230 | 11/1968 | Dupuis . | |
| 4,209,824 | 6/1980 | Kaufman . | |
| 4,286,399 | 9/1981 | Funahashi et al. . | |
| 4,861,505 | 8/1989 | Farman . | |
| 4,934,079 | 6/1990 | Hoshi | 446/175 |
| 4,967,317 | 10/1990 | Plumly | 40/550 |
| 5,183,429 | 2/1993 | Bitton | 446/73 |
| 5,316,689 | 5/1994 | Farrell | 446/153 |
| 5,575,098 | 11/1996 | Goettel-Schwartz | 40/550 |

FOREIGN PATENT DOCUMENTS

| | | | |
|---|---|---|---|
| 2309985 | 12/1973 | Germany | 446/485 |

*Primary Examiner*—Robert A. Hafer
*Assistant Examiner*—Jeffrey D. Carlson

[57] ABSTRACT

A novelty soap bar is disclosed. The bar comprises an attractor module within a soap body made of substantially translucent or transparent soap, surrounding the attractor module. The attractor module comprises a water impermeable shell; an electronic, actuatable circuit within the shell adapted to cause emission of at least one of a visible and an audible signal, perceptible through the soap body; and a battery within the shell for providing energy to the circuit to cause emission of the visible signal. The module further comprises a light sensitive switch, mounted within said soap body to sense light exterior to said soap body, and interconnected with the circuit and the battery, to inhibit flow of current from the battery in the absence of light; and a motion sensitive switch interconnected with the circuit, to activate the circuit in response to sensing motion of the soap bar. The attractor module may be arranged to produce an animated sequence visible through the soap bar. The animated sequence may be formed using LEDs, LCDs, reflective sheets, or an electromechanical carousel.

10 Claims, 6 Drawing Sheets

FIG.9A.
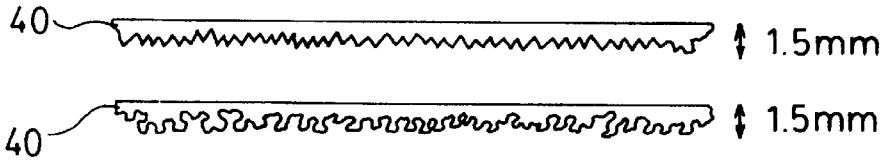
FIG. 9.
FIG.10.
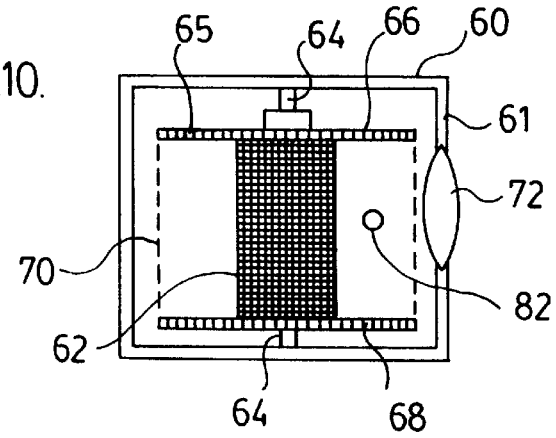
FIG.11.
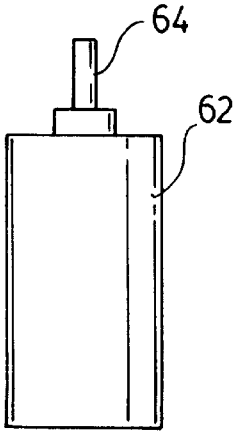
FIG.12.
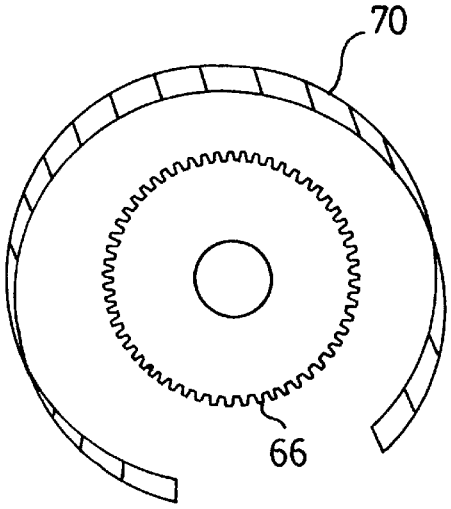
FIG.13.
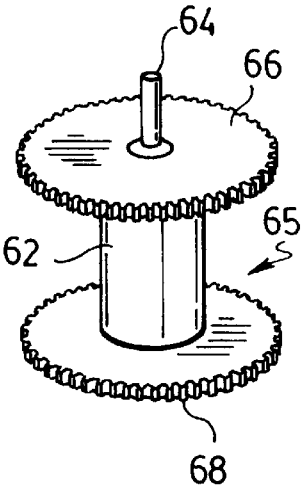

NOVELTY SOAP

FIELD OF THE INVENTION

The present invention relates generally to soap, and more specifically to soap bars incorporating an electronic or electromechanical attractor such as an animated display, toy or game.

BACKGROUND OF THE INVENTION

Generally, children loathe using soap. Numerous schemes designed to entice children to use soap, have been conceived. For example, soaps with child desirable scents such as bubble gum, are available. Character merchandising has resulted in soap bars taking the shape of, or being sold in cases depicting, known cartoon characters to attract children.

U.S. Pat. No. 5,183,429 discloses a children's toy and bath soap assembly incorporating a toy encapsulated within a bar of soap. The body of the soap is transparent or translucent so that the toy is visible when the soap is being used. Moreover, the soap body and the toy have similar or complementary shapes. Children are thus reminded of the incentive to use the soap and liberate the toy, each time the soap is used. As well, preferably, the soap packaging is transparent so the soap and toy may be viewed upon purchase. The toy, however, is generally static, and may be a figurine, and thus is likely not appreciated for long once liberated.

U.S. Pat. No. 4,861,505 discloses a novelty soap bar incorporating a water-impermeable housing containing an electronic circuit which sends forth a visible signal, tone, melody or message, and is activated by a switch. The switch may be opened or closed in the presence or absence, of a magnetic field. This magnetic field may be created by a specially adapted soap dish. Alternatively, or additionally, the circuit may be activated by a vibration or temperature sensitive switch. Thus, a child is enticed to remove the soap from the dish in order to activate the circuit which acts as an attractor. In order to prevent the electronic circuit from being activated prior to sale of the soap, the soap may be sold in association with a specially adapted soap dish or the packaging may include magnets which may be discarded upon opening. This may be wasteful and expensive. Moreover, the disclosed circuit simply flashes several LEDs or plays a tune. This form of attractor may have limited appeal to children.

The present invention attempts to overcome some of the disadvantages of the prior art.

SUMMARY OF THE INVENTION

It is an object of the present invention to provide an improved novelty soap device, comprising an electric circuit and providing increased incentive for a child to use a bar of soap, while preferably being conveniently distributable without using up batteries.

In accordance with one aspect of the present invention, there is provided a novelty soap bar comprising: an attractor module within a soap body made of substantially translucent or transparent soap, surrounding said attractor module; said attractor module comprising: a water impermeable shell; an electronic, actuatable circuit within said shell adapted to cause emission of at least one of a visible and an audible signal, perceptible through said soap body; a battery within said shell for providing energy to said circuit to cause emission of said signal; a light sensitive switch, mounted within said soap body to sense light exterior to said soap body, and interconnected with said circuit and said battery, to inhibit flow of current from said battery in the absence of light; and a motion sensitive switch interconnected with said circuit, to activate said circuit in response to sensing motion of said soap bar.

In accordance with another aspect of the present invention, there is provided in combination, a light impermeable container for holding a novelty soap bar, and a novelty soap bar, said soap bar comprising: a soap body, having a hollow interior, said soap body made of substantially translucent or transparent soap; an attractor module in said hollow interior, said module comprising: a water impermeable shell; an electronic, actuatable circuit within said shell adapted to cause emission of a visible or audible signal, perceptible through said soap body; a battery within said shell for providing energy to said circuit to cause emission of said visible signal; a light sensitive switch, mounted within said soap body to sense light exterior to said soap body, and interconnected with said circuit and said battery, to inhibit flow of current from said battery in the absence of light, when said soap is in said container.

In accordance with a further aspect of the present invention, there is provided a novelty soap bar comprising: a soap body made of substantially translucent or transparent soap; an attractor module within said soap body, said soap body surrounding said attractor module; said attractor module comprising: a water impermeable shell, said shell having a substantially transparent front; a transparent first sheet visibly mounted within said shell behind said transparent front, said first sheet comprising a side coated with a first thin one-way mirrored layer having a first front face, said first layer being substantially transparent to reveal a first image on said first sheet when viewed through said transparent front in the presence of light on a face opposite said front face and said first layer being substantially reflective to conceal said first image in the absence of light on said face opposite said first front face; a second sheet mounted within said shell behind and spaced from said face opposite said first front face, said second sheet having a side coated with a second thin one-way mirrored layer, said second mirrored layer having a second front face, said second front face facing said face opposite said first face on said first sheet, said second layer being substantially transparent to reveal a second image on said second sheet in the presence of light on a face of said second sheet opposite said second front face and said second layer being substantially reflective to conceal said second image in the absence of light on said opposing face opposite said second front face; a first light source mounted between said first and second sheet; a second light source mounted to emit light on said opposing face opposite said second front face; an electronic circuit within said shell adapted to cause emission of light from at least one of said first and second light source to reveal and conceal at least one of said first and second image as viewed through said transparent front; a switch in communication with said circuit to activate said circuit and at least one of said first and second light source.

BRIEF DESCRIPTION OF THE DRAWINGS

In the figures which illustrate, by way of example, embodiments of the present invention.

FIG. 9 is a side plan view of an element shown in FIG. 8;

FIG. 9*a* is an alternate side plan view of an element shown in FIG. 8;

FIG. 10 is cross sectional view of an attractor module in accordance with an aspect of the present invention;

FIG. 11 is a view of a portion of the module of FIG. 10;

FIG. 12 is top view of a portion of the module of FIG. 10;

FIG. 13 is a perspective view of a portion of the module of FIG. 10;

DETAILED DESCRIPTION OF THE PREFERRED EMBODIMENT

Figure 1:
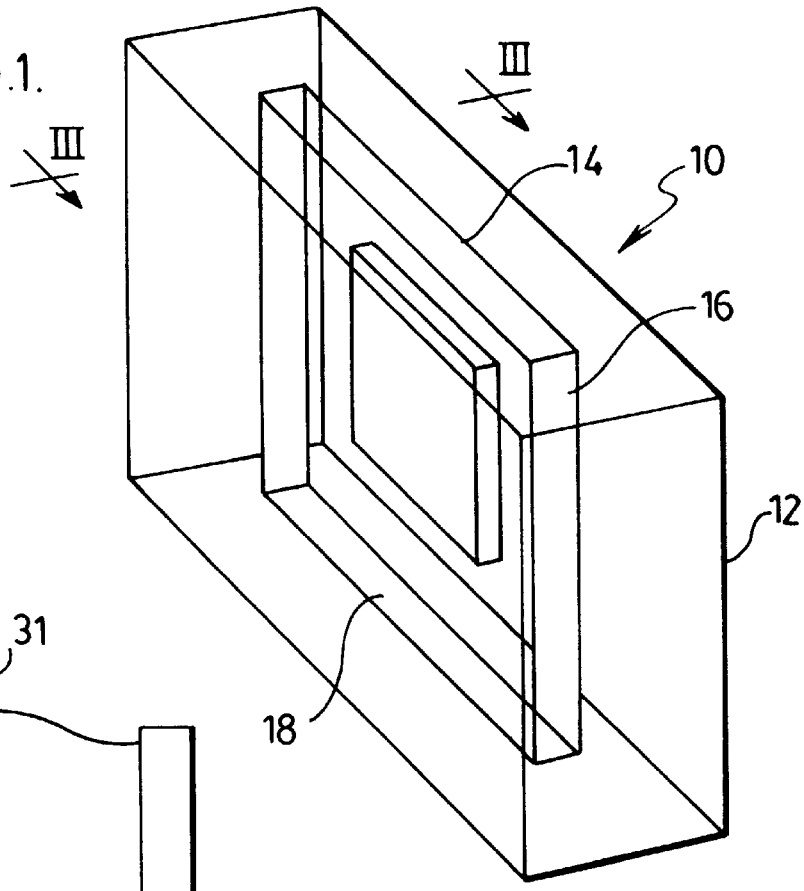
FIG. 1 is a perspective view of a novelty soap product in accordance with an aspect of this invention.

As illustrated in FIG. 1, novelty soap 10 comprises a soap bar 12 that encapsulates an attractor module 14. Soap bar 12 is made of conventional soap, but is formed so as to be transparent, substantially transparent, or translucent.

Figure 2:
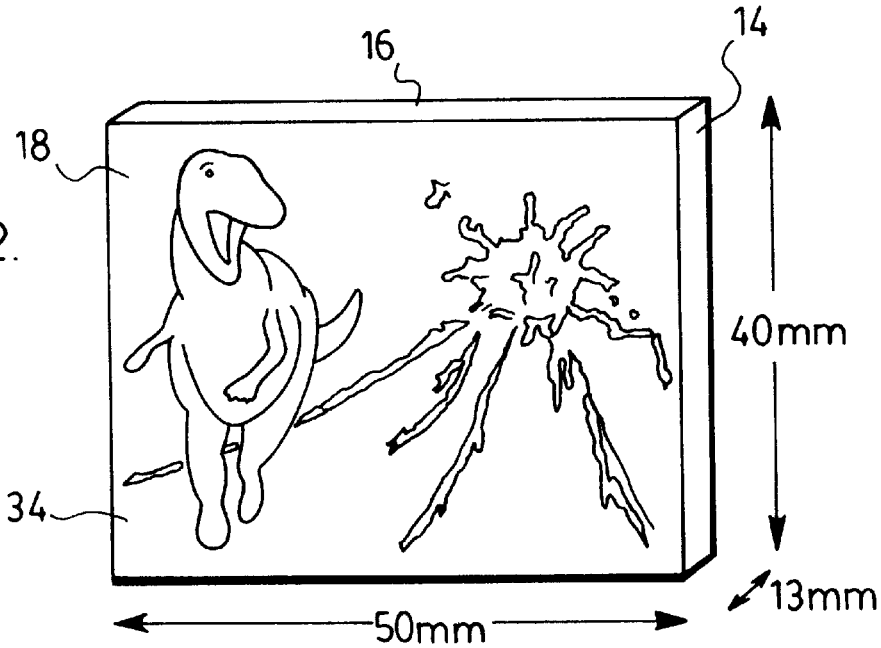
FIG. 2 is a perspective view of an element of the soap of FIG. 1.

With reference to FIG. 2, attractor module 14 comprises a generally rectangular outer shell 16 which is sealed and water-proof or water impermeable. Outer shell 16 may, for example, be made of plastic or rubber, and has a transparent front portion 18. As soap bar 12 (FIG. 1) is transparent, outer shell 16 is visible through soap bar 12.

Figure 3:
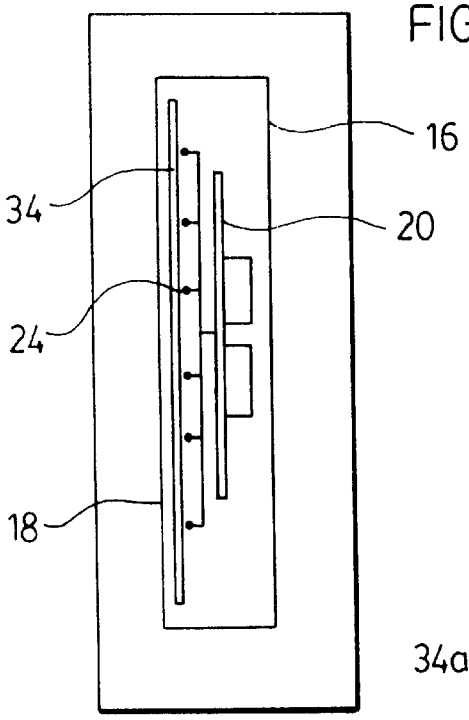
FIG. 3 is a cross-section of FIG. 1 along line III—III.
Figure 6:
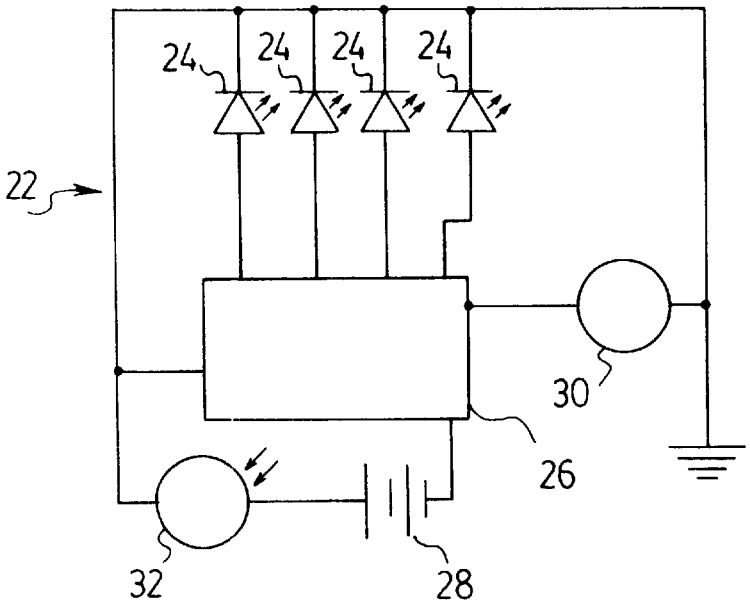
FIG. 6 is schematic diagram of a circuit used in the soap of FIG. 1.

As best illustrated in FIG. 3, within shell 16 is a printed circuit board 20 carrying a plurality of electronic components, including light emitting diodes (LEDs) 24 forming a circuit (generally 22 in FIG. 6). A battery 28 is mounted on board 20. Additionally, within shell 16, a film 34 is mounted between printed circuit board 20 and the inner surface of front portion 18 of shell 16, extending generally over the entire inner surface of front portion 18. Film 34 and LEDs 24 are mounted so that LEDs 24 are in close proximity to film 34.

Figure 4:
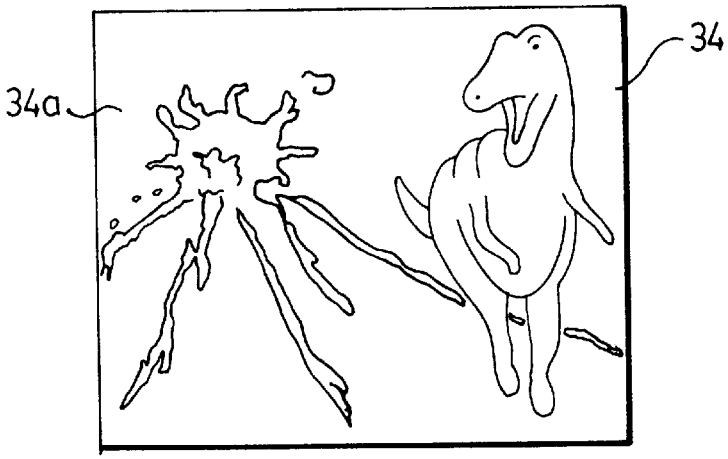
FIG. 4 is front plan view of an element shown in FIG. 2.
Figure 5:
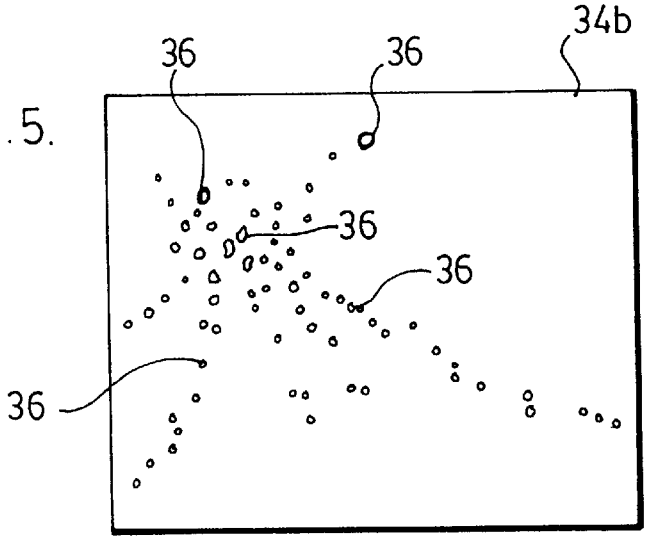
FIG. 5 is a rear plan view of FIG. 4.

As shown in FIGS. 4 and 5, a front face 34*a* of film 34 comprises a translucent photographic negative image printed onto a transparent mylar or acetate sheet. Film 34 is preferably planar and rigid or semi-rigid. The image of film 34 is visible through front portion 18 and through soap bar 12.

The image of film 34 is chosen to lend itself to relatively simple animation. For example, the image may be one of a volcanic mountain, an animal or the like. Film 34 is chosen so that certain areas are of particular significance, in the context of the image. By highlighting these areas, the image may be animated, as more particularly described hereafter. Further, a rear face 34*b* of film 34 (FIG. 5) opposite front face 34*a* comprises a solidly coloured backing layer which is preferably white. Key areas of the rear face 34*b* of film 34 lack the coloured backing layer, thus forming pin-hole like regions 36 in the film, as shown in FIG. 5. As such, film 34 is substantially transparent at these pin-hole regions 36, allowing light to pass therethrough. As will be appreciated, the front face of film 34 could alternatively be coloured with pin hole regions, achieving the same effect.

Pin-hole regions 36 vary in size. Conveniently, the pin-hole areas 36 are chosen directly behind key regions within the image printed on the front of the transparent sheet. LEDs 24 (FIG. 3) are arranged to rest behind these pin holes so that light may be emitted through the sheet by LEDs 24. The key regions are chosen so that the image on the sheet appears animated, as the LEDs 24 are lit, as more particularly described below.

With reference to FIG. 6 circuit 22 comprises a number of LEDs 24, an integrated circuit ("IC") 26, a battery 28, a motion sensitive switch 30, and a light sensitive switch 32. Preferably, IC 26 will be a low power consuming integrated circuit, to prolong the life of battery 28 when in use. LEDs 24 are conventional LEDs and may be chosen in any suitable colour, as desired. Again, preferably LEDs are low power consumption LEDs. Battery 28 is a conventional battery to provide power to IC 26 and LEDs 24. It is mounted on circuit board 20, opposite LEDs 24 (as seen in FIG. 3). Alternatively, several batteries may be used.

IC 26 and LEDs 24 are arranged so that IC 26 causes LEDs 24 to be activated in sequence in order to simulate animation in the image on the front face of film 34, as described below. Additionally, IC 26 preferably includes a timing circuit that stops IC 26 from activating LEDs 24 after being activated a desired pre-set time interval.

Motion sensitive switch 30 is interconnected with IC 26. Upon sensing motion, switch 30 provides a signal to IC 26 so that it may activate LEDs 24 in a particular sequence, for a pre-set time interval, as desired. Additionally, a further light sensitive switch 32 is connected directly to battery 28 and IC 26 to prevent activation of the entire circuit 22 in the absence of sufficient ambient light. Light switch 32 is in optical communication with the exterior of housing 16, through for example front portion 18, and also with the exterior of soap 10, through transparent soap bar 12. Light sensitive switch 32 is chosen/designed so that switch 32 will close and the circuit may be activated at very low light levels. The light level required to activate the switch may be adjusted by design. Absent any light, switch 32 will be open, thereby preserving battery 28.

Figure 1A:
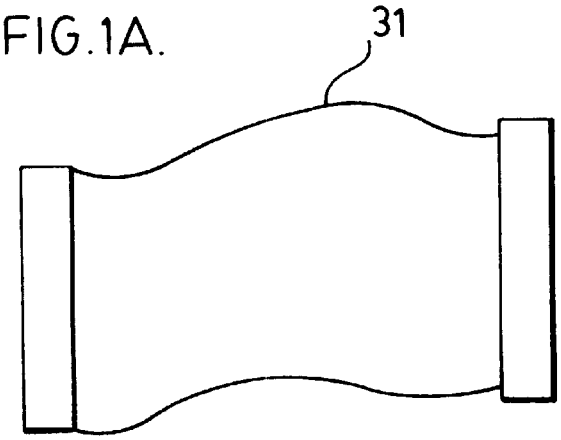
FIG. 1*a* is a perspective view of a container for a novelty soap product in accordance with an aspect of the invention.

Soap 10 may thus be sold in a light impermeable package, 31 as shown in FIG. 1*a*, so that the exterior of soap bar 12 is not exposed to any light and circuit 22 cannot be activated until the package has been opened, thus preserving the shelf life of battery 28. Preferably the package 31 holding the soap will not be resealable and may, for example, comprise an opaque wrapper, or sack, optionally having a reflective interior providing a light free interior when sealed. Alternatively, soap bar 10 may be sold in a transparent blister package or a package with certain areas of the soap bar visible through a transparent window during transportation from the factory to the retail store. Soap bar 10 may additionally be packed in a sealed master carton and thus not exposed to any light, even when packed in a blister pack. Therefore circuit 22 cannot be activated until the master carton has been opened exposing soap 10 to sufficient ambient light as detected by light sensitive switch 32 and simultaneously subjected to motion as detected by motion sensitive switch 30. IC 26 can only activate Led 24 when there is sufficient ambient light and motion at the same time.

Figure 7:
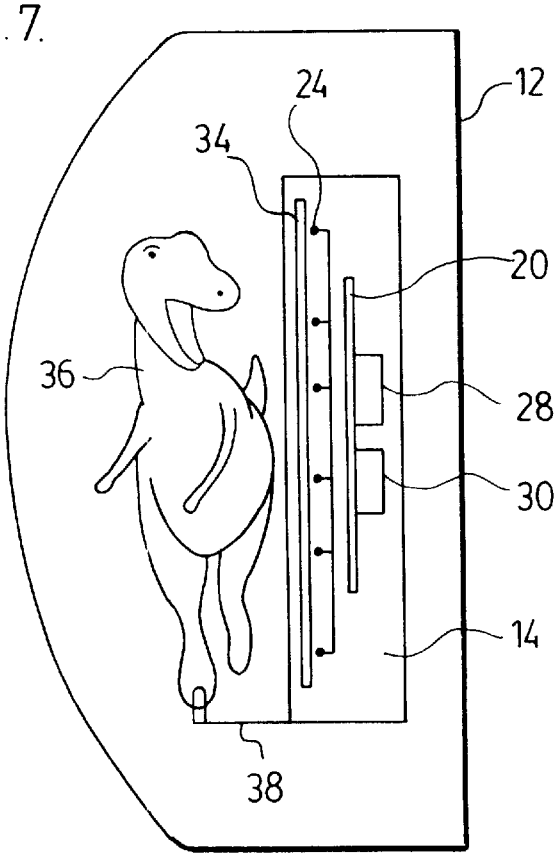
FIG. 7 is a cross section of a further novelty soap product in accordance with another aspect of the invention, similar to FIG. 3.

As illustrated in FIG. 7, a three-dimensional figurine 36 may be added to the interior of soap body 12. Figurine 36 is placed directly in front of attractor module 14, and may be attached thereto by a small plastic extension piece 38, extending outwardly from module 14. Figurine 36 is preferably complementary to the image of film 34, thereby effectively interacting with any animation provided by means of film 34. Soap 10 may be made thicker or have an convex outer surface in order to accommodate figurine 36, and may be moulded around figurine 36.

Figure 8:
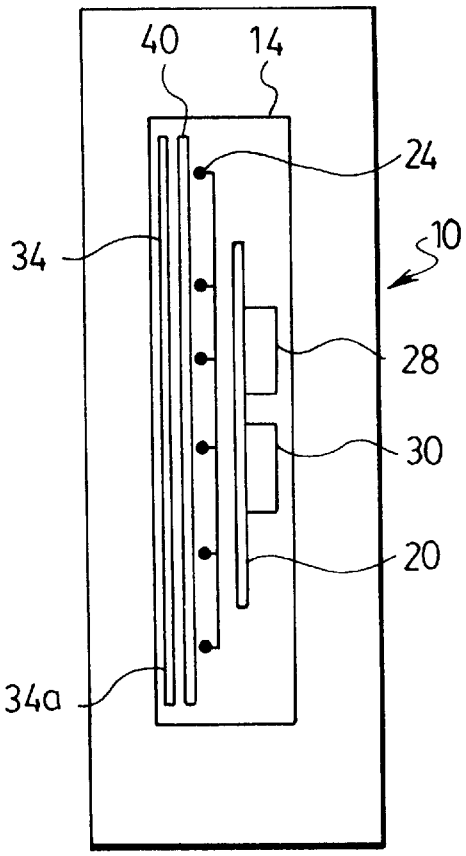
FIG. 8 is a cross section, similar to FIG. 3 of a modified form of the soap of FIG. 1.

Additionally, as illustrated in FIGS. 8, 9 and 9*a*, a thin diffuser sheet 40 may be interposed between LEDs 24 and film 34. Sheet 40 has a length and width generally equal to that of film 34, and a thickness of approximately 1.5 mm, somewhat thicker than film 34. Sheet 40 is transparent or translucent, and certain regions of sheet 40 have a jagged cross-section, that may be formed randomly, or may be formed in a set diamond-shaped pattern, as illustrated in FIGS. 9 and 9*a*. The sheet 40 may be formed of plastic. The jagged cross-section diffracts light passing through sheet 40 at those regions. These jagged cross-sectioned regions are located within sheet 40 and behind film 34 so that light emitted by LEDs 24 at or near those regions will be scattered and have particular significance, providing an enhanced visual effect on for image on the face 34*a* of film 34. Light from LEDs 24 travels onto diffuser sheet 40, and is refracted due to the irregular cross-section of diffuser sheet 40. The resulting scattered light produces a large, soft halo-like lighting effect on the opposite side of film 34. By contrast, the lighting visible on the opposite side of sheet 34, absent diffuser sheet 40 would be viewed sharp circular image. Additionally, the multiple cuts and etchings of diffuser 40 causes partial reflections and diffraction of the light, producing a prism-like effect. This enhanced lighting effect draws further attention to the pin-hole regions on film 34.

Attractor module 14 is completely assembled and sealed prior to the formation of soap bar 12, which may be moulded about attractor module 14. If desired, attractor module 14 may include a battery storage compartment with a resealable flap (not shown) to allow for replacement of battery 28, once module 14 has been removed from soap body 12.

In use, soap 10 is packaged in an opaque sack 31 (FIG. 1*a*) or box, and sold. A display model exhibiting the functionality of the device may be present at the point of sale. Once bought, soap 10 may be removed from its container 31, exposing it to light. Alternatively, the soap 10 could be packaged in a blister pack, and be exposed to light at the point of sale. However, prior to arriving at the point of sale, the soap would be stored in a generally opaque shipping carton. Once exposed, light passes through soap body 12, and impacts light sensitive switch 32, through soap body 12. Switch 32, in turn activates circuit 22. Switch 32 will activate circuit 22 in the presence of sufficient ambient light. Soap 10 may then be placed on any conventional bathroom or kitchen soap storage location, such as a soap tray, where it rests motionless until used. Once soap 10 is picked up, switch 30 causes circuit 22 to activate LEDs 24 to sequentially flash these LEDs 24. Flashing LEDs 24 are visible through film 34. Film 34 is also very visible through soap body 12. Flashing LEDs 24 in association with the image printed on the sheet of film 34 creates an illusion of animation within bar 12. For example, as noted above, the photographic image may depict a volcano. Exposed pin-hole areas 36 in front of LEDs 24 may be chosen to define a lava trail on the side of this volcano. Alternatively, exposed pin-hole areas in front of LEDs 24 may be chosen to define the eyes of an animal in the image. IC 26 flashes LEDs 24 so that the lava in the image appears to flow, or the eyes of the animal appear to blink or glow. Colours of LEDs 24 are chosen appropriately. The light is diffused by the diffuser 40 and to further enhance the display of light on the image (FIGS. 9, 9*a* and 10).

A child, seeing the film 34 in the soap, with natural curiosity, will be drawn to the visible image, visible through body 12 and will be drawn to investigate, picking up the soap to further view the animated image. Drawn by the animation, the child will wish to use the soap, and view the image in action. Optimally, the child will wish to use the soap bar housing module 16 again and again. As an added incentive, attractor module 14, may be saved once the soap is used so that a child will have a motion activated animated scene, which may be collected or used.

Circuit 22 may be adapted to continue the animation sequence for a short time after motion has initially been detected by switch 30.

The motion sensitive switch 30 working in tandem with the light sensitive switch 32 also provides a safety feature during use of soap bar 10 in the bath or shower. Fascinated by the activity of LEDs 24 and animation inside soap bar 10, a child may be tempted to turn off all the lights in the bathroom to play with soap bar 10 while still inside the bath tub. This may increase the risk of an accident or injury to the child resulting from the darkness inside the room. When light sensitive switch 32 detects the absence of ambient light in the room, switch 32 opens and incapacitates activation of circuit 22 even though the motion sensitive switch 30 detects motion. This may be a disincentive to using the soap in the dark. IC 26 can only activate LED 24 when there is sufficient ambient light detected by motion sensitive switch 32 and is simultaneously subjected to motion which is detected by motion sensitive switch 30.

Figure 13A:
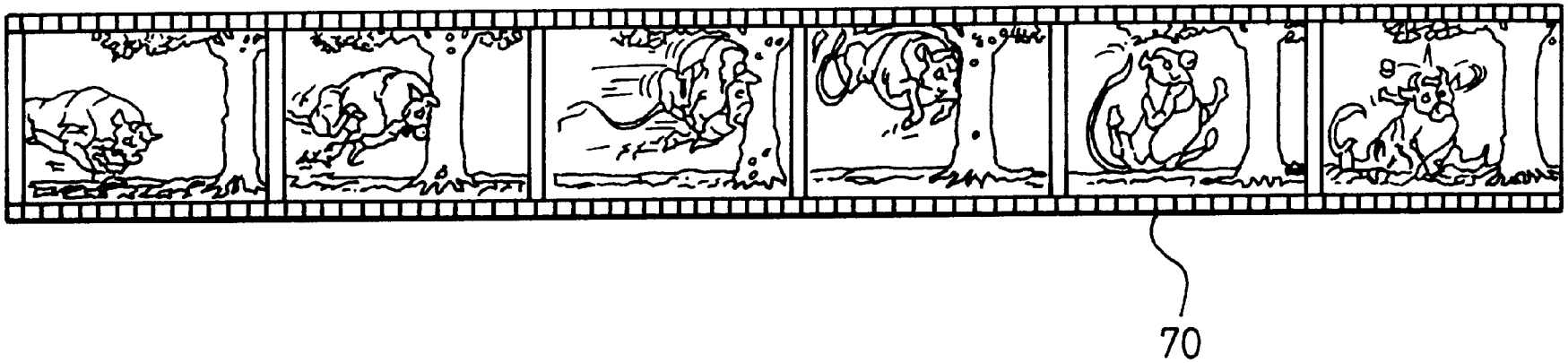
FIG. 13*a* is a further plan view of a portion of the module of FIG. 10.

In a second embodiment, a novelty soap comprises a generally transparent soap body encapsulating an attractor module 60 as illustrated in FIGS. 10–13*a*. Attractor module 60, comprises a shell 61. Mounted vertically within shell 61 is a carousel assembly 65 comprising an electronic motor 62, toothed wheels 66, 68, and film strip 70 all rotatably mounted about shaft 64. Toothed wheels 66 and 68 are mounted about shaft 64 near its ends. Wrapped about toothed wheels 66 and 68 is film strip 70, having sprocket holes near its edges. The teeth of wheel 66 and 68 tightly engage the sprocket holes, so that rotation of toothed wheels 68 and 70 about shaft 64 causes rotation of film 70 about shaft 64. Film strip 70 comprises a transparent mylar sheet with a series of images printed on its face, as shown in FIG. 13*a*. An electronic circuit (similar to circuit 22) comprising a battery, motion sensitive switch, light sensitive switch, LEDs, and IC (not shown) forms part of module 60. The IC of module 60, like IC 26, is adapted to flash LEDs interconnected with it. As with circuit 22, a light sensitive switch keeps the circuit of module 60 from functioning in the absence of light. Similarly, a motion sensitive switch sends a signal activating the IC whenever module 60 is moved. The circuit, in the presence of sufficient light and upon sensing motion, activates motor 62 to cause rotation of toothed wheels 66, 68 and film strip 70 about shaft 64. At the same time the circuit causes LEDs (a single LED 82 is illustrated) to be activated. LED 82 may flash, or remain constantly on, when activated. LED 82 is mounted behind film 70, proximate the outer housing of motor 62 and is preferably stationary relative to axis 64 (FIG. 10). Light emitted by LED 82 is visible through film strip 70, housing 60, and an associated soap body. A convex viewing lens 72 may further form part of housing 60 thereby providing an enlarged view into shell 61 which is visible through the exterior of housing 60, and the soap body housing module 60. LED 82 is mounted between shaft 64 and lens 72. Thus, as film strip 70 rotates about axis 64, images will rotate past lens 72, and will be illuminated from behind by LED 82, creating an animated scene through viewing lens 72 and in turn through the transparent shell 61 housing module 60. The diffuser 40 may optionally be interposed between LED 82 and film strip 70 providing an enhanced visual effect of animation.

Motion of soap bar will cause carousel 61 to rotate about axis 64, and LED 82 to emit light, again capturing the imagination and fascination of a child by presenting a series of apparently animated images visible through the soap bar. Once liberated attractor module 60 may also be used or collected.

Figure 14:
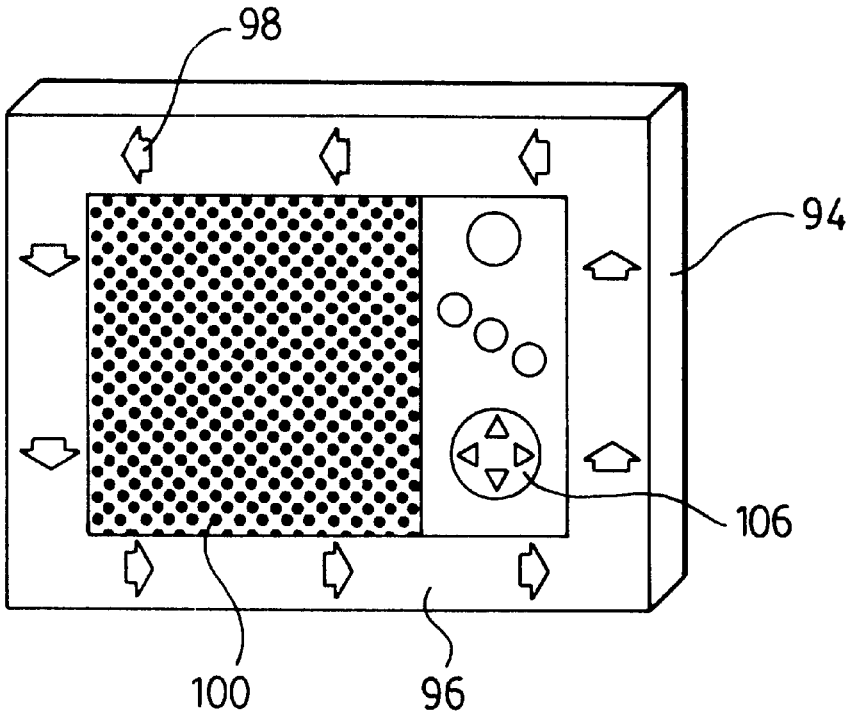
FIG. 14 is a front view of another attractor module in accordance with an aspect of the present invention.

In yet a further embodiment as illustrated in FIG. 14, a novelty soap comprises a transparent soap body having an attractor module 94 mounted in its interior. Attractor module 94 comprises an electronic video game module having a liquid crystal display ("LCD") dot matrix screen 100 on its front face 96. Face 96 is visible through the soap body containing module 94. The video game module also comprises a processor (not shown), and at least one controller 106. Additionally, a series of LEDs 98 may be mounted on face 96 about screen 100. LEDs 98 may be used in conjunction with diffusing lenses naming the shape of arrows or other signs. The processor controls the video game module and directs dot matrix display 100 to display an animated "attraction" sequence, or an interactive video game in "game mode". Additionally, forming part of attractor module 94 is a light/motion sensing circuit similar to the light and motion sensing portion of circuit 22. These sensors ensure that attractor module is only active, while encapsulated in a soap body, if the light sensors senses sufficient light exterior to the soap housing module 94 and the motion sensor senses that attractor module 94 is, or has recently been, moved. In response to sensing motion, the processor of module 94 may initiate animation on display screen 100 and cause LEDs 98 to flash in sequence, making the arrows "circle" about screen 100. Game controller 106 is also embedded within soap body, and is thus not accessible until attractor module 94 has been liberated from the soap body. Controller 106 may be used to interactively play a video game presented on display screen 100 by the processor, when the attractor module is in a game mode. The module may be put in game mode by initially contacting controller 106. As such, attractor module will remain in its "attract" mode while encapsulated in a soap bar, and will only be put in game mode once controller 106 is accessible after the module is liberated. Alternatively, the game and controller features of module 94 need not be included, and the LCD display screen 100 could simply be used to display messages and scenes designed to attract use of the soap.

For novelty soap incorporating module 94 of FIG. 14, motion of the soap will cause attractor module 94 to present an animated attraction sequence on LCD display 100. Additionally LEDs 98 are sequentially activated to further make picking up the soap desirable. Once liberated the game forming part of attractor module 94 may be played by way of controller 106.

Figure 15:
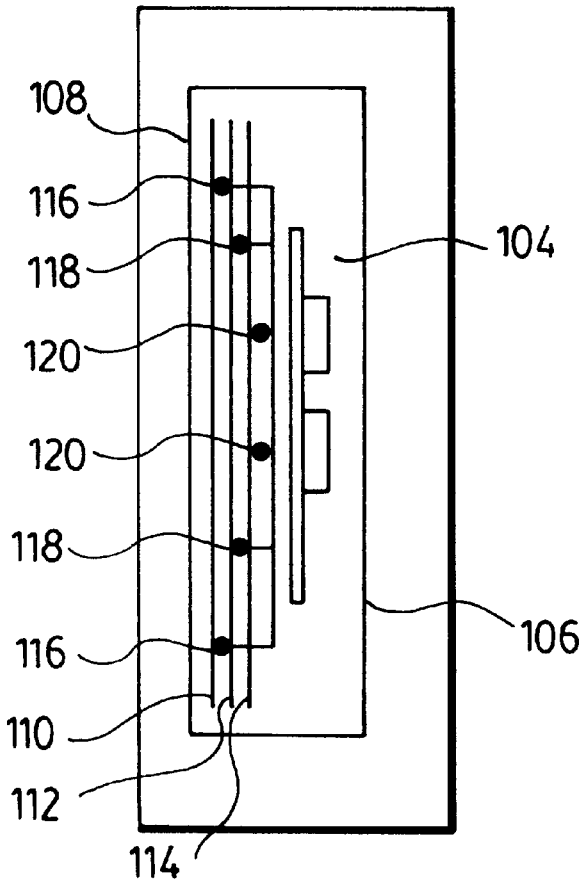
FIG. 15 is a cross sectional view of yet another attractor module in accordance with an aspect of the present invention, similar to FIG. 3.

FIG. 15 illustrates yet a further embodiment of an attractor module 104 suitable for use in the interior of a hollow soap body. Attractor module 104 comprises a casing 106, having a substantially transparent front face 108. Casing 106 is made of plastic. Mounted behind front face 108 are a number of acetate sheets 110, 112, and 114 spaced from each other. Mounted behind each of the acetate sheets is at least one LED 116, 118 and 120. Each acetate sheet 110, 112 and 114 has printed on its front face, facing outward away from casing 106, a thin layer of partially silvered pellicle. This pellicle has reflection properties of a two way mirror. Printed on the opposite face of each sheet is an image. In the absence of a light source behind each sheet, this image is obstructed by, or blends in with the pellicle layer. Mounted behind each sheet 110, 112 and 114 are LEDs 116, 118 and 120 respectively. When these LEDs are activated, the pellicle on the sheet directly in front of the sheet becomes virtually invisible when viewed from the front. Thus, with proper choice of images printed upon sheets 110, 112 and 114 and sequential activation of LEDs 116, 118 and 120 the images on sheets 110, 112 and 114 may be animated. Thus, by lighting LED 116 then 118 and then 120, the images on sheets 110, 112 and 114 will be sequentially revealed effectively creating an animation sequence involving these images. LEDs 116, 118 and 120 may form part of an electronic circuit similar to circuit 22 of FIG. 6, which may sequentially activate LEDs 116, 118 and 120 in response to sensing exposure to motion and/or light by module 104.

A person skilled in the art will appreciate that many modifications of the above embodiments are possible. For example, the animation sequence (ie. LED lighting sequence, or LCD display sequence) may change from time to time, encouraging repeated use of the soap. Similarly a speaker and sound playing circuit adapted to emit an audible sound may be incorporated in any of attractor modules 14, 60, 94, 104. This may allow for the playing of a melody in response to motion of the soap housing the modules 90. Light sensor 32 may extend from the attractor module to ensure it properly senses ambient light conditions.

It will be understood that the invention is not limited to the illustrations described herein which are merely illustrative of a preferred embodiment of carrying out the invention, and which are susceptible to modification of form, size, arrangement of parts and details of operation. The invention, rather, is intended to encompass all such modification within its spirit and scope, as defined by the claims.

We claim:

1. A novelty soap bar comprising an attractor module within a soap body which is made of a light permeable soap material surrounding said module, said module comprising a water impermeable shell and an electronic circuit encased within said shell, said circuit including signaling means to produce a signal perceptible through said shell and said soap body, a battery to operate said signaling means, a light sensitive switch which closes said circuit only when subjected to light penetrating from outside of said soap bar to said light sensitive switch and which otherwise opens said circuit, and a motion sensitive switch which upon sensing motion of said soap bar provides a signal which causes activation of said signaling means only when said circuit is closed by said light sensitive switch, said signaling means being immediately deactivated when said circuit is opened by said light sensitive switch even when said soap bar is in motion.

2. The novelty soap bar of claim 1, wherein said shell comprises a transparent wall and said attractor module comprises a translucent film mounted behind said wall within said module, said film comprising a first face bearing a translucent image, having a substantially solidly coloured backing;

said solid backing having clear pin-hole regions forming substantially transparent pin-hole regions on said film adapted to pass light through said regions;

said circuit comprising a plurality of light sources mounted behind said pin-hole regions to emit light through said pin-hole regions, said light visible through said wall and said soap body.

3. The novelty soap bar of claim 2, wherein said film comprises a second face opposite said first face, and wherein said backing is formed by substantially, solidly colouring said second face.

4. The novelty soap bar of claim 3, wherein said second face is coloured white.

5. The novelty soap bar of claim 2, wherein said circuit when activated, lights said light sources in sequence and said pin-hole regions are located on said image so that said light sources, when lit in sequence, simulate animation on said image.

6. The novelty soap bar of claim 2, wherein said module further comprises a diffuser mounted between said film and said light sources, said diffuser adapted to diffract light emitted by said sources onto said film near said pin-hole regions.

7. The novelty soap bar of claim 2 wherein said light sources comprise a plurality of light emitting diodes.

8. A soap bar as claimed in claim 1 wherein said signaling means provides a visual signal.

9. A soap bar as claimed in claim 1, wherein said signaling means provides an audible signal.

10. A soap bar as claimed in claim 1 when contained within a light impermeable container for shipping said soap bar.

* * * * *